US008033413B2

(12) United States Patent
Gerson et al.

(10) Patent No.: US 8,033,413 B2
(45) Date of Patent: Oct. 11, 2011

(54) LIQUID SUPPLY ASSEMBLY

(75) Inventors: Ronald L. Gerson, Carlisle, MA (US); Pierre LaPointe, North Dartmouth, MA (US); Robert A. Brunell, Forestdale, MA (US)

(73) Assignees: Saint-Gobain Abrastives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 1069 days.

(21) Appl. No.: 11/762,890

(22) Filed: Jun. 14, 2007

(65) Prior Publication Data

US 2008/0011879 A1 Jan. 17, 2008

Related U.S. Application Data

(60) Provisional application No. 60/828,245, filed on Oct. 5, 2006, provisional application No. 60/815,142, filed on Jun. 20, 2006.

(51) Int. Cl.
*B65D 45/00* (2006.01)

(52) U.S. Cl. ..... 220/315; 220/495.02; 239/332; 239/333; 239/354; 239/375; 239/601

(58) Field of Classification Search ..... 220/315, 220/495.02; 239/332, 333, 354, 375, 601
See application file for complete search history.

(56) References Cited

U.S. PATENT DOCUMENTS

| | | | | |
|---|---|---|---|---|
| 1,703,384 | A | | 10/1924 | Birkenmaier |
| 2,612,404 | A | | 9/1952 | Andersson |
| 2,670,239 | A | * | 2/1954 | Ditch ..... 239/415 |
| 2,770,706 | A | | 11/1956 | Vogtle et al. |
| 3,236,459 | A | | 2/1966 | McRitchie |
| 3,255,972 | A | | 6/1966 | Hultgren et al. |
| 3,401,842 | A | | 9/1968 | Morrison |
| 3,432,104 | A | | 3/1969 | Kaltenbach |
| 3,776,408 | A | | 12/1973 | Wald |
| 3,892,360 | A | | 7/1975 | Schlottmann et al. |
| 4,043,510 | A | | 8/1977 | Morris |
| 4,151,929 | A | | 5/1979 | Sapien |
| 4,430,084 | A | * | 2/1984 | Deaton ..... 604/317 |
| 4,930,644 | A | | 6/1990 | Robbins |
| 4,936,511 | A | | 6/1990 | Johnson |

(Continued)

FOREIGN PATENT DOCUMENTS

DE 298 25 015 U1 4/2004

(Continued)

*Primary Examiner* — Anthony Stashick
*Assistant Examiner* — Elizabeth Volz
(74) *Attorney, Agent, or Firm* — Abel Law Group, LLP; Joseph P. Sullivan

(57) ABSTRACT

A connector system for attaching a liquid container to a spray gun includes a lid with a liquid outlet and an adapter that connects the outlet with the liquid inlet port of the gun. The lid includes interlocking tab assemblies for releasably attaching the adapter to the lid. The connector system combines with an outer cup, a ring for insertion into the mouth of the cup and a collapsible liner for insertion into the ring to form a liquid container system. The ring includes internal threads that cooperate with a peripheral flange on the lid to lock the lid to the ring, securing the lip of the liner. The lid includes a flexible gasket to form a liquid tight seal with the liner. The lid-liner-ring forms a liquid tight unit that may be inserted into and removed from the outer cup while containing a fluid such as paint.

16 Claims, 16 Drawing Sheets

U.S. PATENT DOCUMENTS

| | | | |
|---|---|---|---|
| 4,971,251 | A | 11/1990 | Dobrick et al. |
| 5,468,383 | A | 11/1995 | McKenzie |
| 5,797,520 | A | 8/1998 | Donahue |
| 5,816,501 | A | 10/1998 | LoPresti et al. |
| 6,302,445 | B1 | 10/2001 | Kugele et al. |
| 6,536,687 | B1 | 3/2003 | Navis et al. |
| 6,588,681 | B2 | 7/2003 | Rothrum et al. |
| 6,595,441 | B2 | 7/2003 | Petrie et al. |
| 6,663,018 | B2 | 12/2003 | Rothrum et al. |
| 6,752,179 | B1 | 6/2004 | Schwartz |
| 6,796,514 | B1 | 9/2004 | Schwartz |
| 6,820,824 | B1 | 11/2004 | Joseph et al. |
| 6,938,836 | B2 | 9/2005 | Bouic et al. |
| 6,946,122 | B2 | 9/2005 | Douglas et al. |
| 6,953,155 | B2 | 10/2005 | Joseph et al. |
| 2003/0209573 | A1 | 11/2003 | Bouic |
| 2004/0016825 | A1 | 1/2004 | Petrie et al. |
| 2004/0084553 | A1 | 5/2004 | Joseph et al. |
| 2004/0118941 | A1 | 6/2004 | Joseph et al. |
| 2004/0140373 | A1 | 7/2004 | Joseph et al. |
| 2004/0164182 | A1 | 8/2004 | Joseph et al. |
| 2004/0256484 | A1 | 12/2004 | Joseph et al. |
| 2004/0256485 | A1 | 12/2004 | Joseph et al. |
| 2005/0067502 | A1 | 3/2005 | Bouic et al. |
| 2005/0145718 | A1 | 7/2005 | Blette et al. |
| 2005/0145723 | A1 | 7/2005 | Blette et al. |
| 2005/0145724 | A1 | 7/2005 | Blette et al. |
| 2005/0279748 | A1* | 12/2005 | Kosmyna ..... 220/495.02 |
| 2006/0196891 | A1 | 9/2006 | Gerson et al. |

FOREIGN PATENT DOCUMENTS

| | | | |
|---|---|---|---|
| DE | 298 25 119 | U1 | 3/2005 |
| DE | 298 25 120 | U1 | 3/2005 |
| EP | 0847809 | A | 6/1998 |
| EP | 0954381 | A1 | 7/1998 |
| EP | 1 210 181 | B1 | 2/2001 |
| EP | 1 366 823 | A1 | 12/2003 |
| EP | 1 415 719 | A1 | 5/2004 |
| EP | 1 435 265 | A2 | 7/2004 |
| EP | 1 579 922 | A1 | 9/2005 |
| WO | WO 95/07762 | | 3/1995 |
| WO | WO 03/006170 | | 1/2003 |
| WO | WO 03/045575 | | 6/2003 |
| WO | WO 2004/037432 | | 5/2004 |
| WO | WO 2004/037433 | | 5/2004 |
| WO | WO 2004/060574 | | 7/2004 |
| WO | WO 2004/060575 | | 7/2004 |
| WO | WO 2004/094072 | | 11/2004 |
| WO | WO2006/065850 | | 6/2006 |

* cited by examiner

DETAIL K

LIQUID SUPPLY ASSEMBLY

This application claims priority from U.S. provisional patent application Ser. No. 60/828,245, filed Oct. 5, 2006, entitled "Liquid Supply Assembly"and bearing attorney docket number 2633/126, the disclosure of which application is incorporated herein by reference; and, this application also claims priority from U.S. provisional patent application Ser. No. 60/815,142, filed Jun. 20, 2006, entitled "Connector System for a Spray Gun Lid"and bearing attorney docket number 2633/124, the disclosure of which application is incorporated herein by reference;

BACKGROUND

Spray guns are widely used for rapidly coating surfaces with liquids, such as paint. Liquid is contained in a container that attaches to the gun. The outlet of the container is typically a releasably connectable coupling that connects to the spray gun. Liquid flows from the container into the spray gun and is fed to a spray nozzle. The spray nozzle combines the liquid with air, atomizing the liquid, forming a spray. At the end of the spraying operation, the container and the mating connection to the spray gun must be thoroughly cleaned so that liquid from one operation does not contaminate the liquid to be sprayed in the next spraying operation. Additionally, the coupling between container and spray gun must not retain any dried liquid that might interfere with the connection between container and spray gun. A container with a disposable liner and lid may be used advantageously to eliminate or reduce the labor required to clean the container and the coupling to the spray gun. A spray gun system with a disposable liner is described in U.S. Pat. No. 6,820,824 to Joseph et al. Other spray gun systems with liners are described in U.S. Pat. No. 3,432,104 to Kaltenbach; U.S. Pat. No. 4,151,929 to Sapien; and U.S. Pat. No. 5,816,501 to Lopresti.

SUMMARY OF THE INVENTION

In embodiments of the present invention, a connector system is provided for releasably attaching a liquid container to a spray gun. The connector system includes a lid with a liquid outlet and an adapter. One end of the adapter connects to the spray gun liquid inlet port and the other end of the adapter connects to a liquid outlet in the lid. The adapter ends are joined by a liquid-tight passageway. Pairs of interlocking tabs on the lid releasably clamp the adapter to the lid. The interlocking tabs will engage the perimeter of the adaptor regardless of the position of the adaptor and without the need for rotating the adaptor to engage the tabs.

In further embodiments of the present invention, a four piece liquid container system is provided for attachment to a spray gun. The system includes a substantially rigid outer support cup, a unitizing ring, a liner and a lid that mates with the unitizing ring. The unitizing ring is inserted into a recess in a flange at the top of the outer cup. A disposable, collapsible liner is inserted through the unitizing ring into the outer cup and a lip at the top of the liner is supported on the unitizing ring. The lid includes a projection to center the lid as it slides into the opening at the liner top but does not engagingly connect to the liner. The lid screws into the unitizing ring and a flexible sealing gasket on the lid projection presses the liner lip against the ring, forming a liquid tight seal. The lid-ring-liner assembly may then be removed from the outer cup as a liquid-tight unit. When the lid is installed on the unitizing ring, the lid-ring-liner assembly may be removably secured to the outer support cup by means of a flexible living hinge on the lid.

BRIEF DESCRIPTION OF THE DRAWINGS

The foregoing features of the invention will be more readily understood by reference to the following detailed description, taken with reference to the accompanying drawings, in which:

FIG. 6B shows a side plan view of the container liner of FIG. 6A; the other side view is similar;

DETAILED DESCRIPTION OF SPECIFIC EMBODIMENTS

In various embodiments of the present invention, a connector system is provided for releasably attaching a spray gun to a liquid container. The connector system includes a liquid container lid with a liquid outlet, an adapter with two ends and interlocking tab assemblies flexibly attached to the lid. One end of the adapter connects to the spray gun liquid inlet port and the other end of the adapter connects to the liquid outlet in the container lid. The adapter ends are joined by a liquid-tight passageway. Interlocking tab assemblies on the top of the lid releasably clamp the adapter to the top of the container lid. Each tab assembly includes a pair of tabs. Each tab is flexibly attached at one end of the tab to the lid top. One tab of each assembly includes an end shaped to securely clamp the adapter to the lid without the need to rotate the adaptor. This clamping tab is free to flex about its attachment point to the lid and includes a hole near the middle of the tab. The end of the second tab of the interlocking tab assembly is formed to fit through the hole in the clamping tab, releasably engaging the tabs. The second tab of the interlocking tab assembly includes a structure adapted to lock the clamping tab in position with respect to the adapter. This locking tab is formed to flex only slightly about its attachment to the lid, thus maintaining the clamping tab in engagement with the adapter, when the tabs are interlocked. Other means for engaging the tabs in each tab assembly may be used such as a snap closure, a hook and eye, etc. as are known to those skilled in the art.

By way of example and not by way of limitation, the connector system may be used with any of the liquid containers shown in co-pending U.S. patent application Ser. No. 11/302,970, entitled "Liquid Container System for a Spray Gun," which is incorporated herein by reference, by appropriate adaptation of the shape of the lid and the locking hinges that attach the lid to the container.

Figure 1:
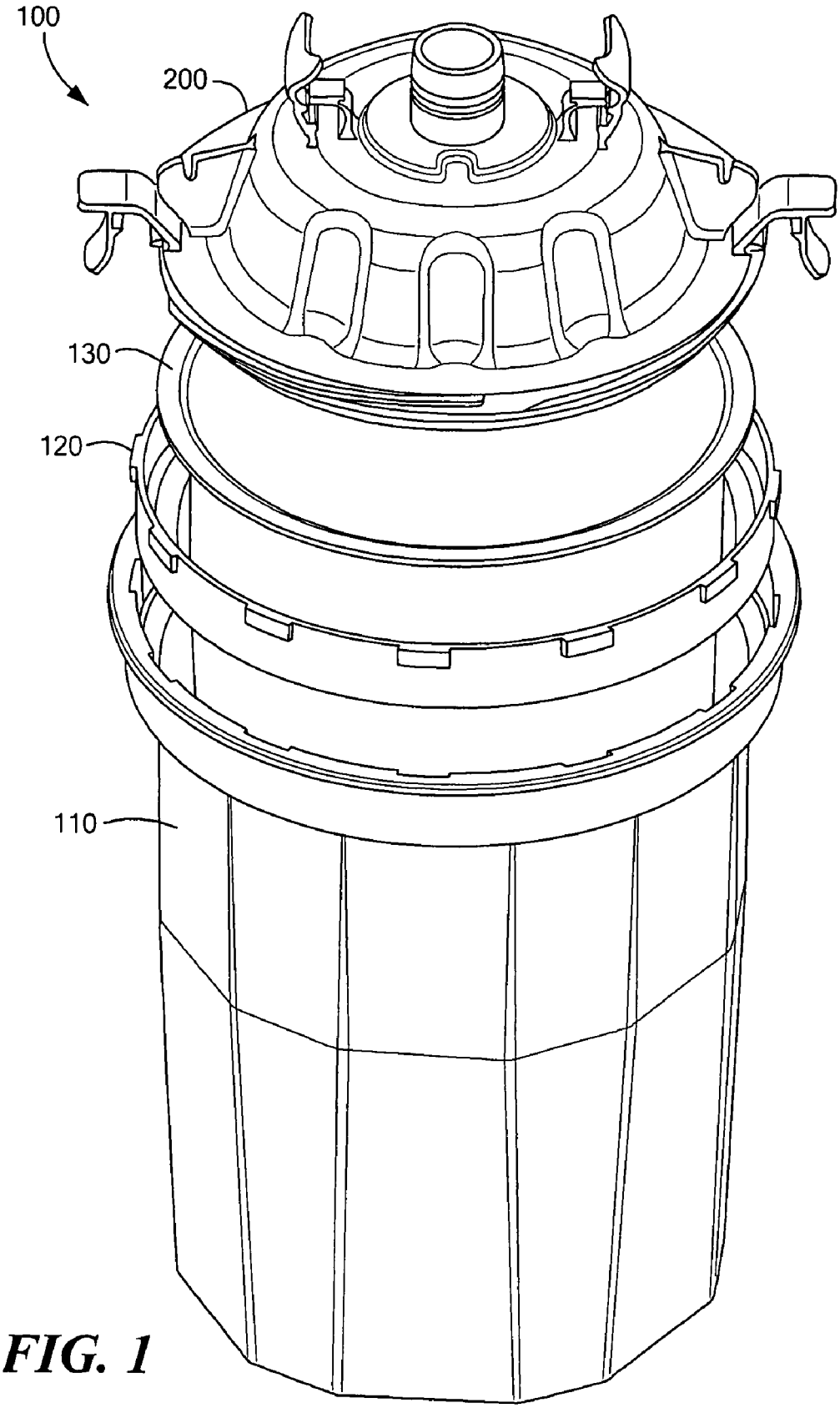
FIG. 1 shows an exploded perspective view of a liquid container system that includes the connector system according to an embodiment of the invention.

FIG. 1 shows an exploded view of a four piece container system in which the connector system of the present invention can be advantageously applied, according to an embodiment of the invention. The connector system attaches the container system to a spray gun for spraying a liquid. The container system includes an outer support cup 110, a unitizing ring 120, a liner 130 and a lid 200. The unitizing ring is inserted into a recess in a flange at the top of the outer cup. A disposable, collapsible liner is inserted through the ring into the outer cup and a lip at the top of the liner is supported on the unitizing ring. The lid includes a projection that slides into the opening at the liner top. The lid screws into the unitizing ring and a flange or a flexible sealing gasket on the periphery of the lid presses the liner lip against the unitizing ring, forming a liquid tight seal. A "unitizing" ring means a ring that in combination with other components (here a liner and lid) allows the combination to be manipulated as a unit. Thus, the lid-ring-liner assembly may be removed from the outer cup as a liquid-tight unit, without the danger of the liquid-filled liner separating from the lid. When the lid is installed on the unitizing ring, the lid-ring-liner assembly may be secured to the outer cup with a locking mechanism.

Figure 2:
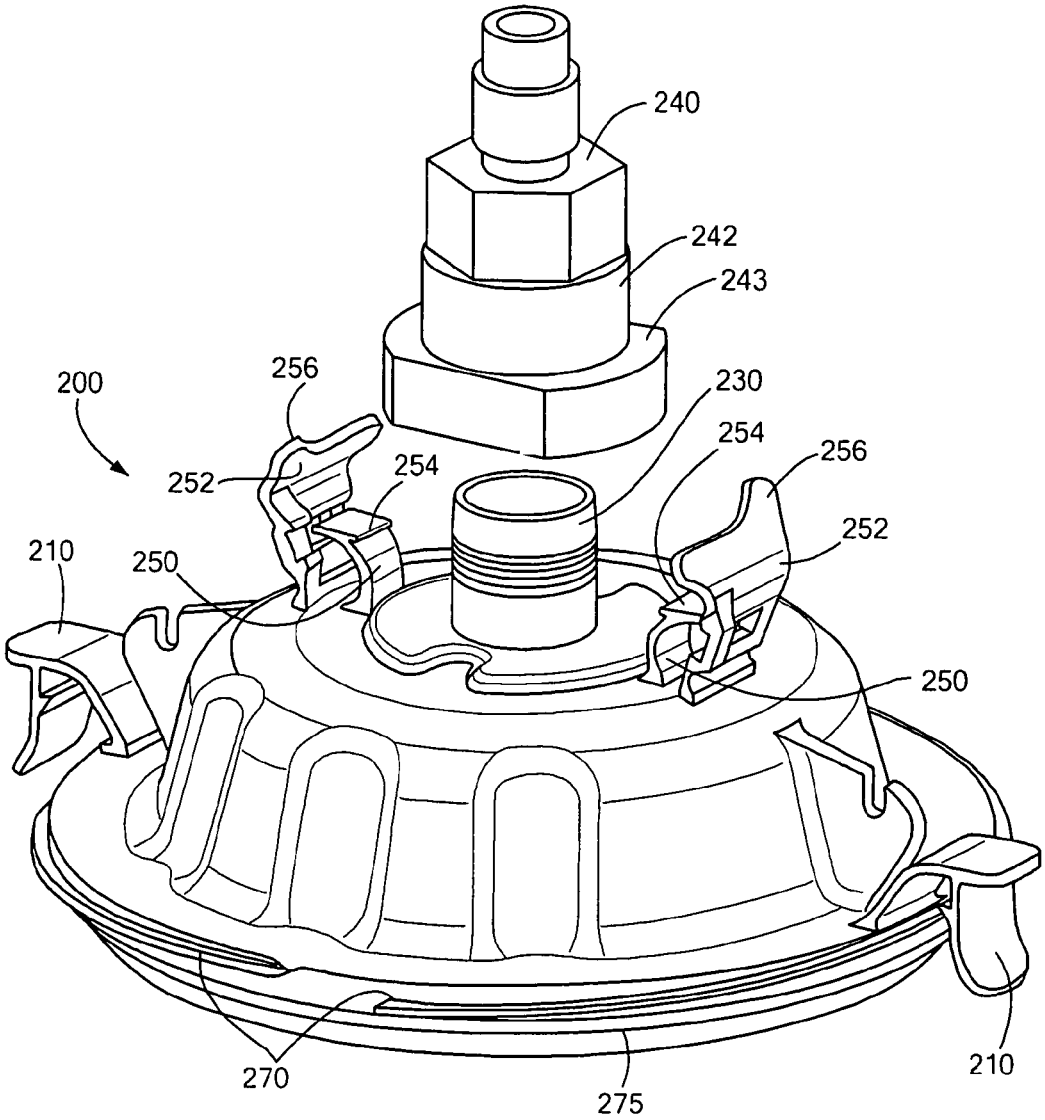
FIG. 2 shows an exploded perspective view of the connector system according to an embodiment of the invention.
Figure 3:
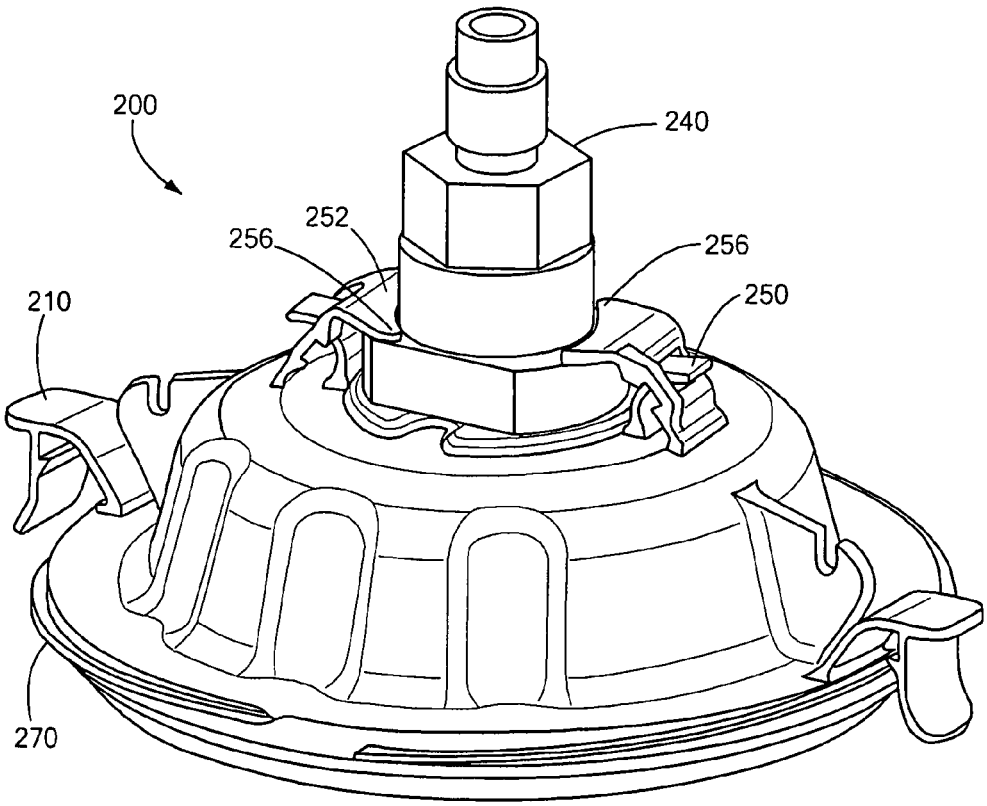
FIG. 3 show a perspective view of the connector system of FIG. 2 with the adapter installed on the lid outlet and the interlocking tabs in an engaged position.
Figure 5:
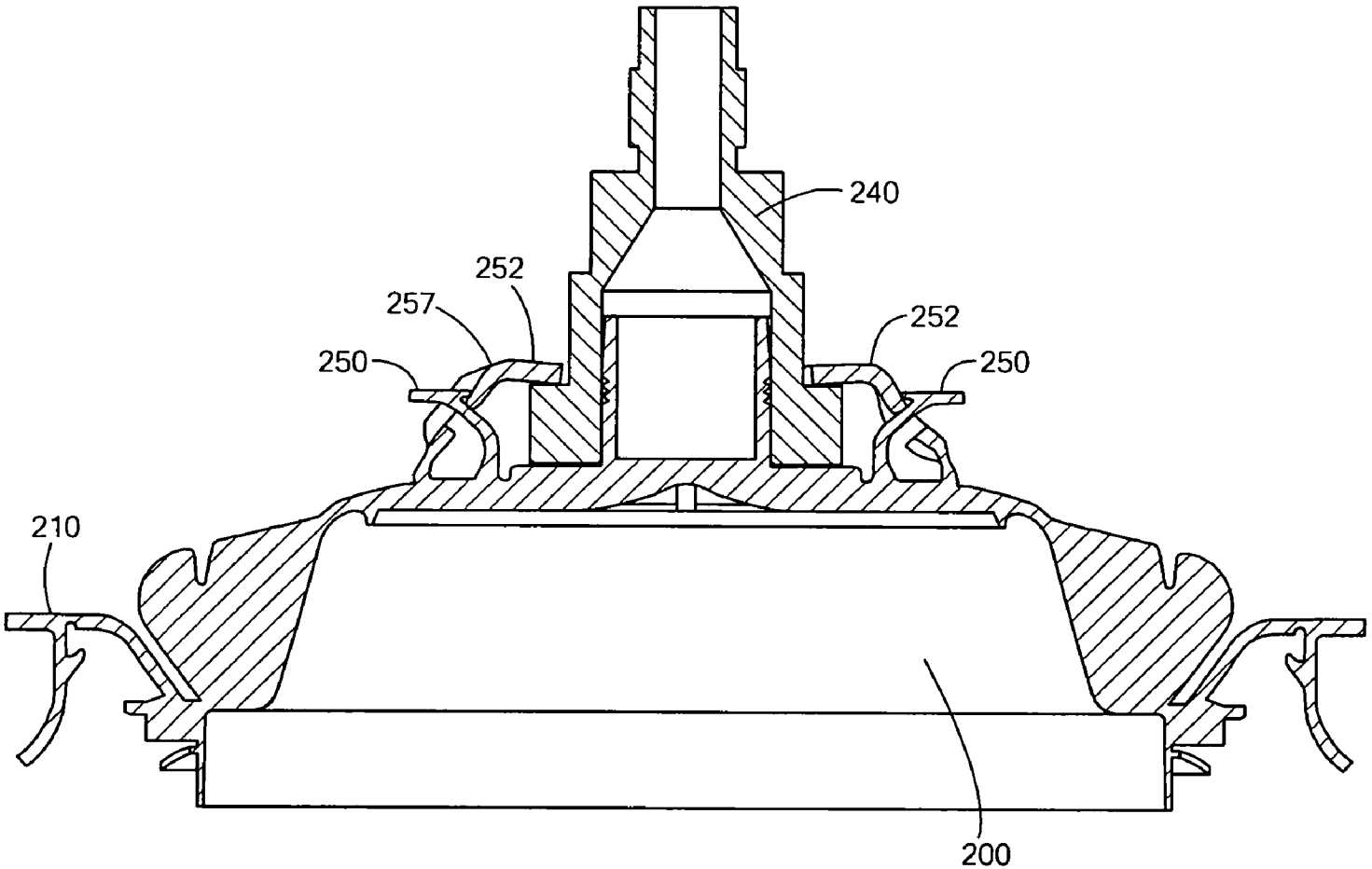
FIG. 5 shows the cross sectional view of FIG. 4 with the interlocking tabs engaged.

In an embodiment of the present invention, as shown in FIG. 2, a connector system is provided that includes a lid 200 and an adapter 240. The lid 200 covers the top of a liquid container that includes an outer cup 110. The lid 200 is inserted into the outer cup 110 and attached to the outer cup by, for example, locking clips or hinges 210 on the periphery of the lid. The lid includes a generally cylindrical liquid outlet 230 in the top of the lid. One end of the adapter 240 connects to the spray gun liquid inlet port (not shown) and the other end of the adapter connects to the liquid outlet 230 in the lid 200. The adapter ends are joined by a liquid-tight passageway. Interlocking tab assemblies (250-252) are attached to the lid 200. When these tab assemblies (250-252) are in an interlocked configuration, the end 256 of tab 252 presses on adapter ledge 243 and clamps the adapter to the liquid outlet 230 of the lid 240, as can be seen in FIGS. 3 and 5. Thus, the adapter is securely fastened to the lid, facilitating use of the spray gun and liquid container in various orientations.

The interlocking tabs assembly (250-252) is shown in FIG. 2 in a non-interlocked configuration. The tab 252 will be called the "clamping" tab because this tab engages the adapter. The clamping tab 252 is biased open (away from the adapter). The tab 250 will be called the "locking" tab because this tab locks the clamping tab into position. The clamping tab 252 includes a hole for receiving an end of the locking tab 250. The hole in the clamping tab 252 and the corresponding end of the locking tab 250 must be shaped in a complementary fashion so that the tab 250 end slides into and through the hole in the clamping tab 252. In a preferred embodiment of the invention, the hole in the locking tab is generally rectangular in shape.

To engage the tabs, a user pushes the clamping tab 252 towards the attached adapter, which threads the locking tab 250 into and though the hole in the clamping tab 252. The locking tab 250 is formed to flex only slightly about its attachment to the lid, thus facilitating engagement of the locking and clamping tabs. This user action engages the tabs of the interlocking tab assembly. The end of each clamping tab 256 presses on the adapter ledge 243 and, thus, clamps the adapter 240 to the lid 200, as shown in FIG. 3. Further, the minimal flex of the locking tab 250 maintains the clamping tab end 256 in secure engagement with the adapter, when the tabs are interlocked. The locking tab includes a locking structure, such as the ridge 254 shown in FIG. 2, to prevent the engaged tabs from separating, by catching the locking structure 254 on the edge of the locking tab hole. The clamping tab 252 may be unlocked from the locking tab by applying downward pressure to the locking tab 250, releasing the locking structure 254 from the hole. The clamping tab 252 will tend to spring away from the adapter to its original position. The adapter may then be removed from the liquid outlet.

Figure 4:
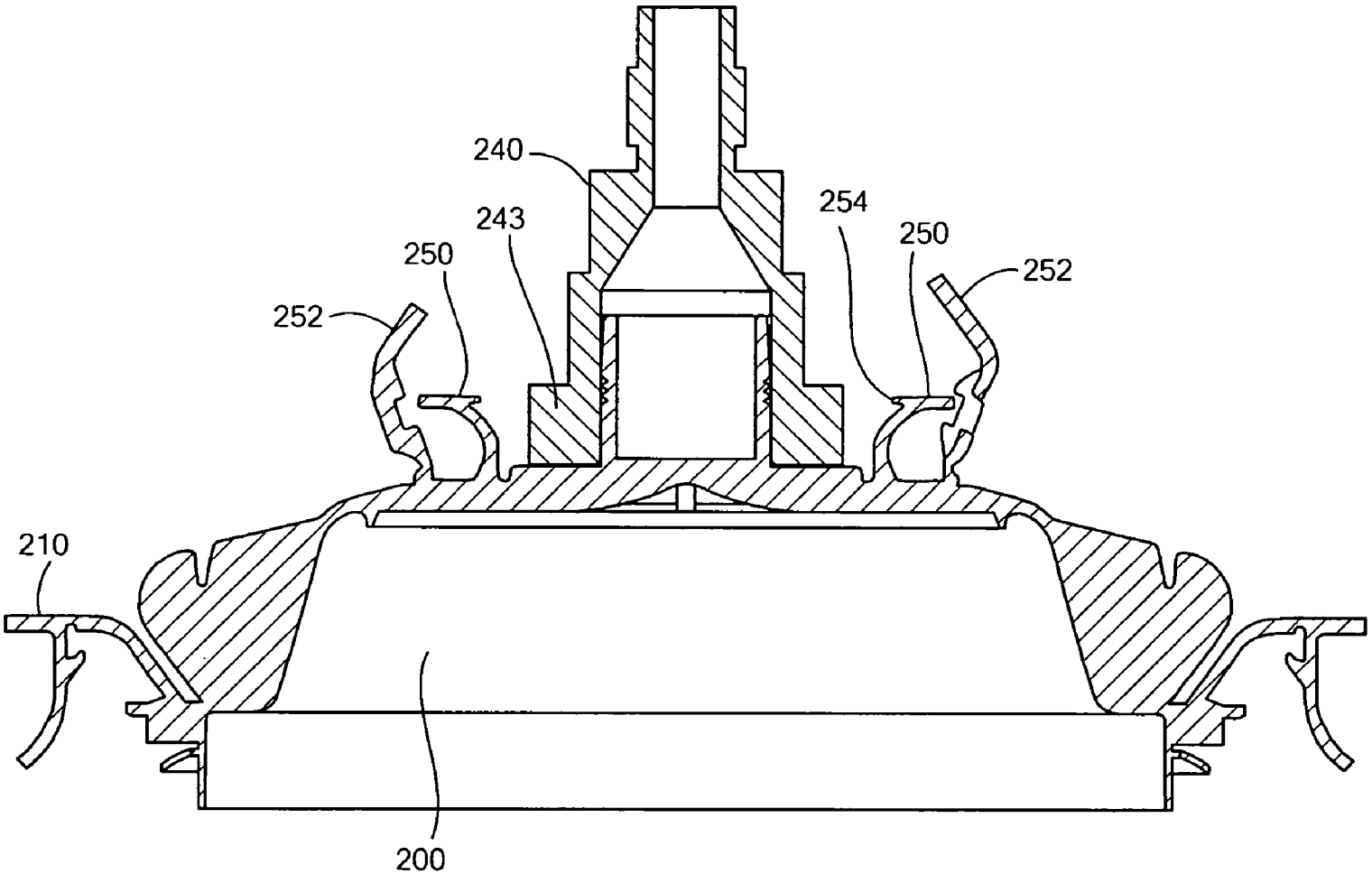
FIG. 4 show a cross sectional view of the connector system of FIG. 2 with the adapter installed on the lid outlet and the interlocking tabs disengaged.

FIG. 3 shows the interlocking tab assemblies (250-252) in an interlocked configuration. The end 256 of the clamping tab 252 presses on the adapter ledge 243 to clamp the adapter 240 to the lid outlet 230. Note the shape of the end 256 of the clamping tab 252. The end 256 of the locking tab 252 is curved to provide a snug fit to the curved portion 242 of the adapter 240 that it contacts, regardless of the position of the adaptor. Thus, in this embodiment, the adapter will remain securely engaged with the liquid outlet for any orientation of the adapter with respect to the liquid outlet, when the adapter is rotated. FIGS. 4 and 5 show a cross-sectional view of the connector assembly system with the interlocking tab assemblies open and closed, respectively. Note in FIG. 4 the bend in the clamping tab 257 between the point where the clamping tab attaches to the lid and the end of the tab 256 that contacts the adapter 240. In embodiments of the invention, the bend 257 in the tab is sufficiently acute that the locking tab flexes at the bend 257 as the tab end 256 contacts the adapter ledge 243. This flex aids in clamping the adapter to the lid.

Two interlocking tab assemblies are shown on the container lid in FIGS. 2-5, but other embodiments of the connector system may have more than two interlocking tab assemblies. Further, other means for engaging the tabs in each tab assembly may be used such as a snap closure, a hook and eye, etc., as are known to those skilled in the art.

In preferred embodiments of the invention, the lid 200 and interlocking tab assemblies (250-252) are injection molded as a single piece, according to techniques known in the art. In a preferred embodiment, the lid and tab assemblies are made of polypropylene. In other embodiments, other materials that are suitable for injection molding may be used. The lid and interlocking tab assemblies are shaped to facilitate release of the molded part from the mold.

Figure 6A:
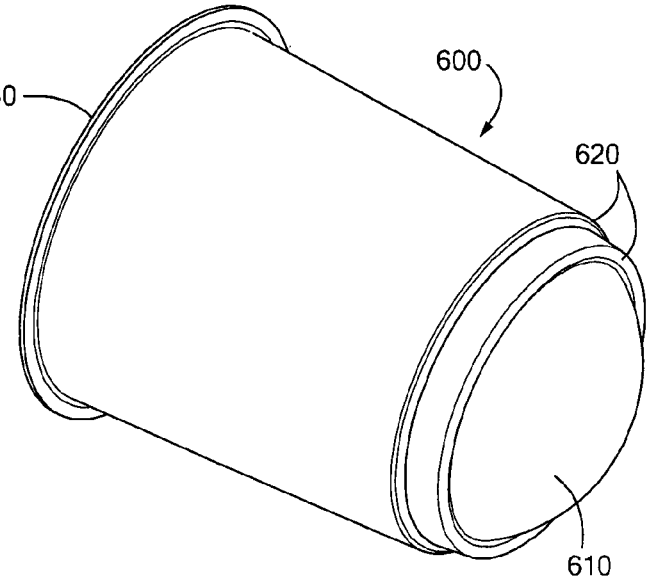
FIG. 6A shows a perspective view of the top and side of a container liner according to a preferred embodiment of the invention.
Figure 6B:
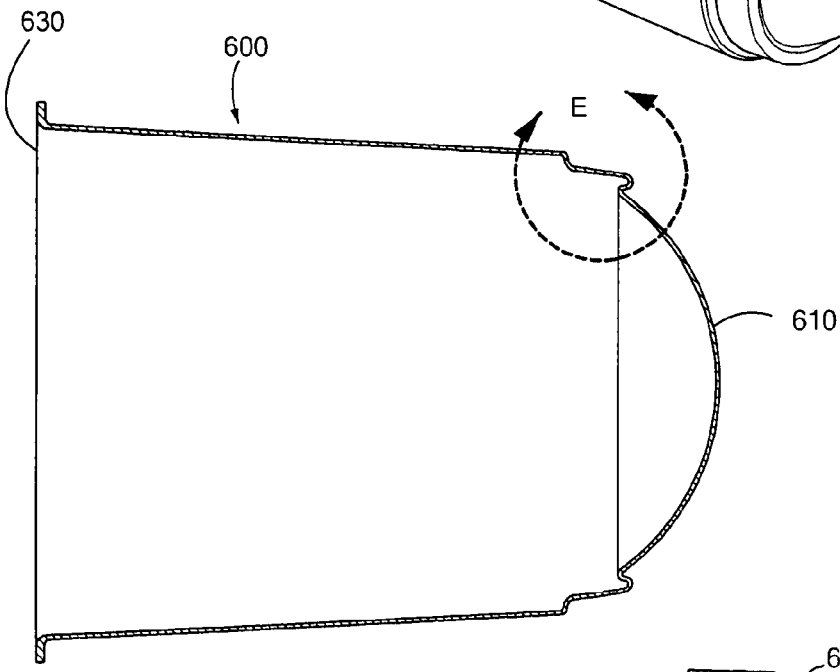
Figure 6C:
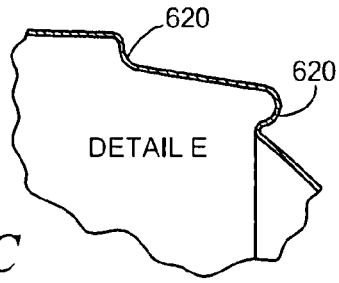
FIG. 6C shows detail of a portion of the liner in FIG. 6B as identified by letter E.
Figure 7:
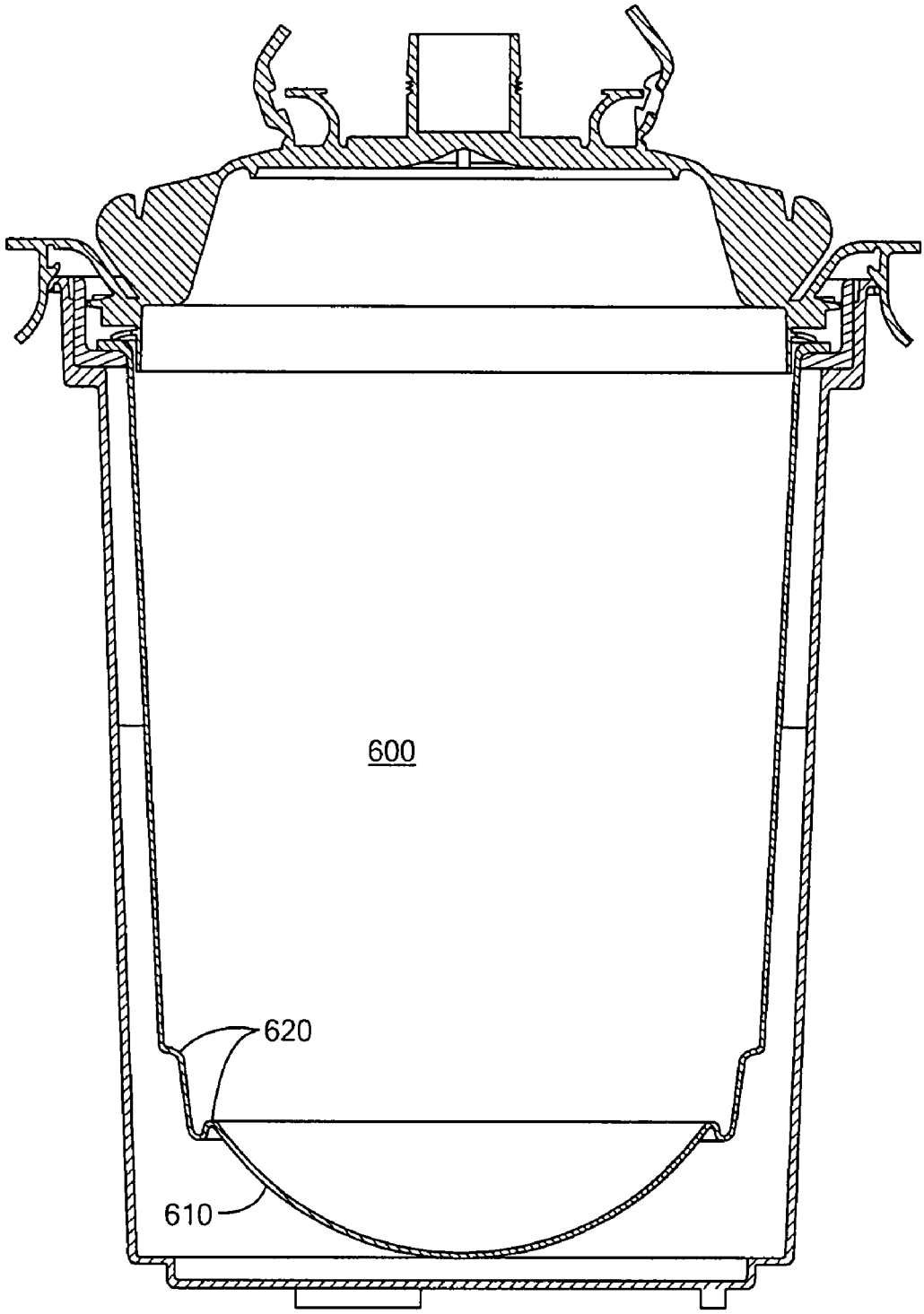
FIG. 7 shows a cross-sectional view of the liner of FIGS. 6A-6C installed in an outer cup.

In another embodiment of the invention, as shown in FIGS. 6A-6C, a disposable liner 600 is provided for use in a liquid container system, such as, for example the container system 100 shown in FIG. 1. The liner has a non-flat closed end 610, an open end 630 for introducing liquid into the liner and one or more horizontal pleats 620 at the closed end. The liner can be made from any nonporous material, including but not limited to, polyethylene, polypropylene or a flexible film. The liner may be rigid or collapsible. In some embodiments of the invention, the liner sidewalls may be thicker than the liner bottom, facilitating storage of liquid in the liner. FIG. 7 shows a cross-sectional view of the liner 600 installed in an exemplary liquid container system. The disposable liner facilitates cleaning of the container system after use.

Figure 8A:
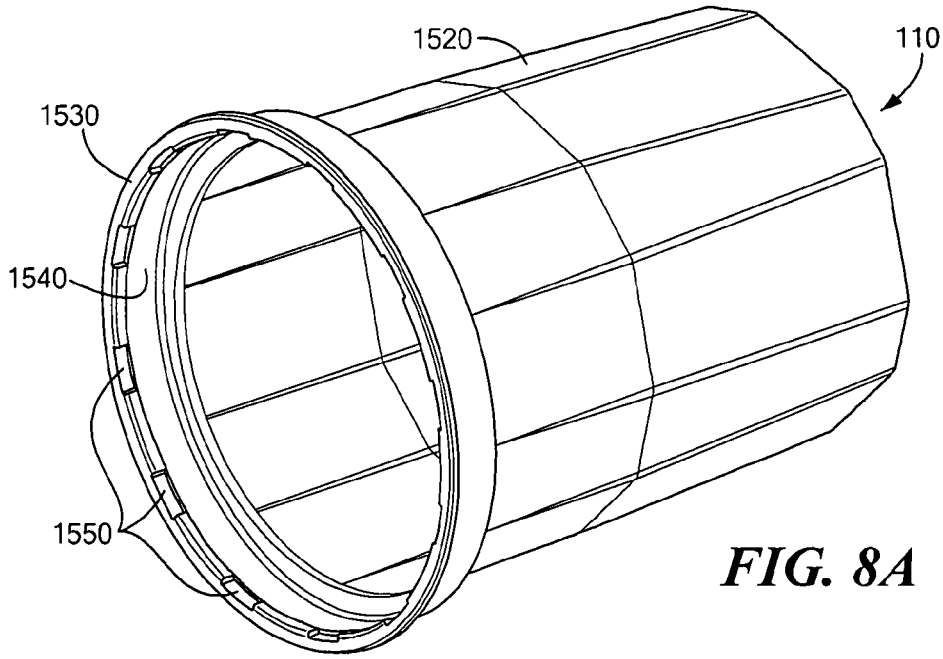
FIGS. 8A-C illustrate an outer cup for a four piece liquid container system, for the embodiment of the invention of FIG. 1.
Figure 8B:
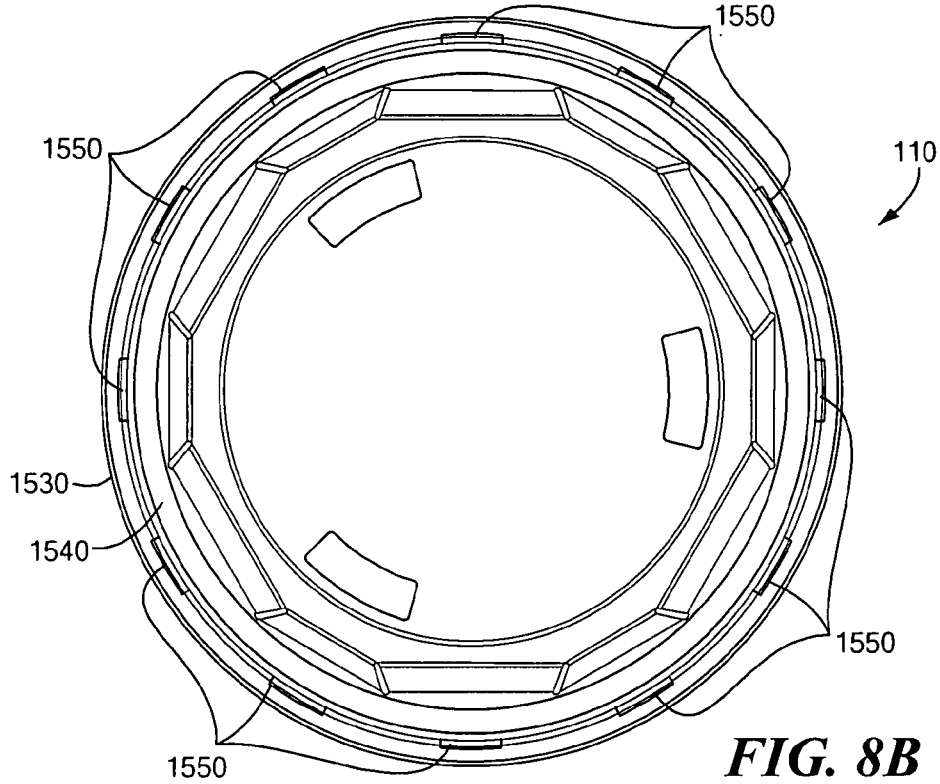
Figure 8C:
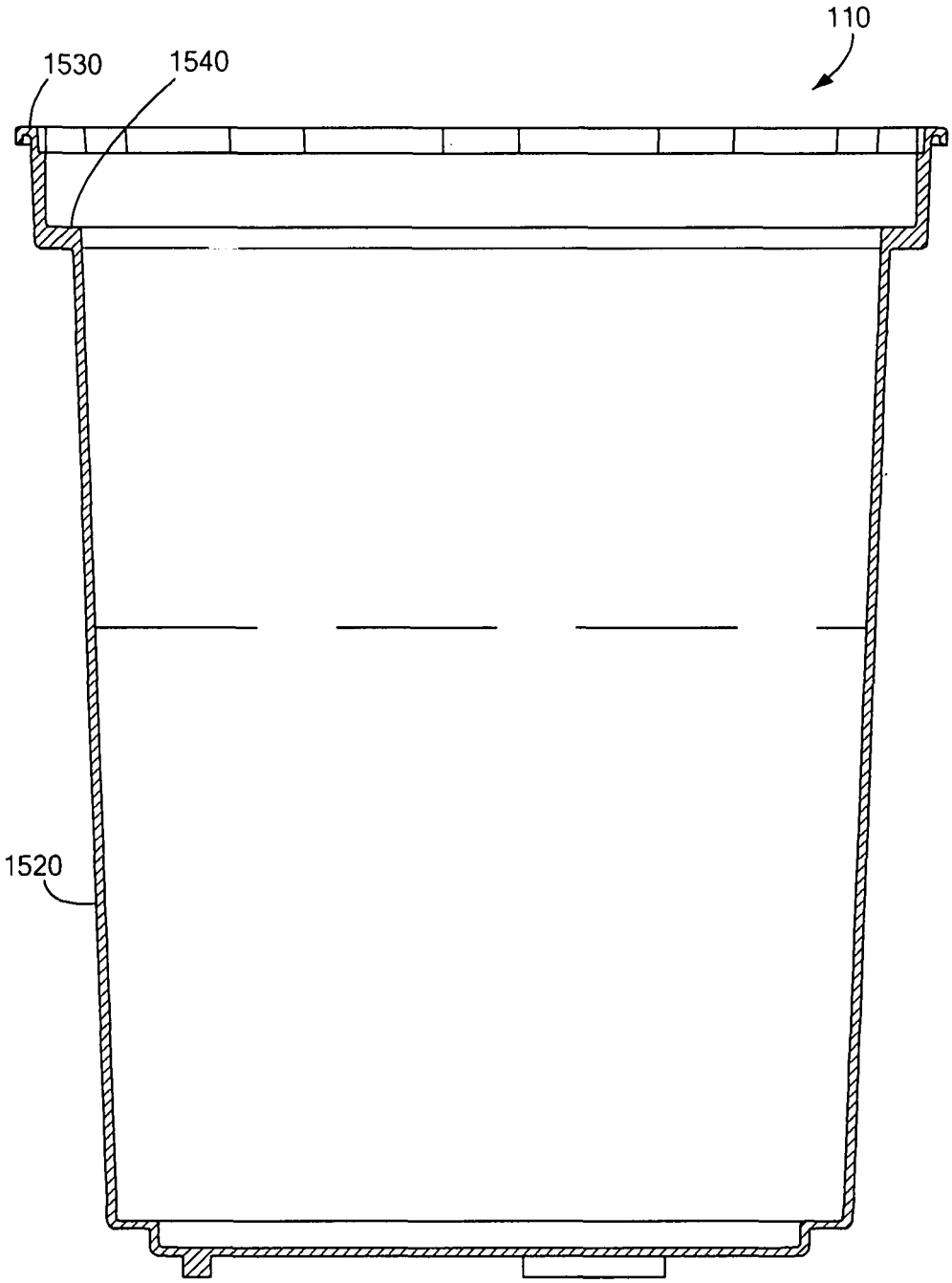

As described above, FIG. 1 shows an exploded view of a four piece container system in which the connector system of the present invention can be advantageously applied. FIG. 8A shows a perspective view of the outer cup 110. The cup is generally cylindrically shaped. The outer cup is made of a relatively stiff material, such as a polymeric material, which provides structural stability. In the embodiment shown in FIG. 8A, the outer wall 1520 of the cup includes facets to facilitate a secure grip of the outer container by the user. In general, however, the outer wall of the outer cup may be implemented with any generally cylindrical shape. The outside and inside bottom of the cup may be flat or may be other than flat. The top of the outer cup includes a generally cylindrical lip 1530 that is concentric with the longitudinal axis of the outer cup. FIG. 8B shows a plan view of the cup lip 1530 as viewed from above. The lip 1530 includes an indentation or recess 1540. This recess 1540 receives and supports the unitizing ring-liner assembly, as will be described below. The cup lip included slots 1550 in the lip's face which is interior to the cup. As will be shown below, tabs in the ring may engage the slots 1550 in the lip's face to prevent mutual rotation of the ring with respect to the cup. FIG. 8C shows the outer cup in cross section. In specific embodiments of the invention, the outer cup includes one or more openings in the cups closed end or sidewall to prevent vacuum formation and to allow paint to be expelled from the container system.

Figure 9A:
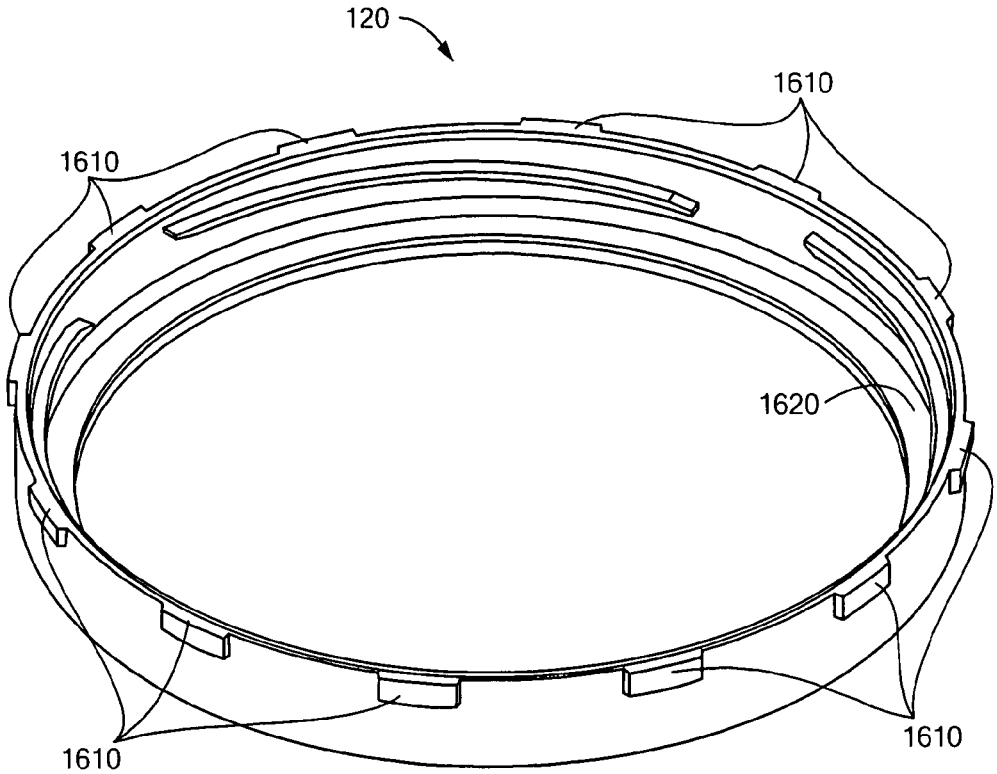
FIGS. 9A-C show a unitizing ring for supporting a liner within the outer cup of the embodiment of FIG. 1.
Figure 9B:
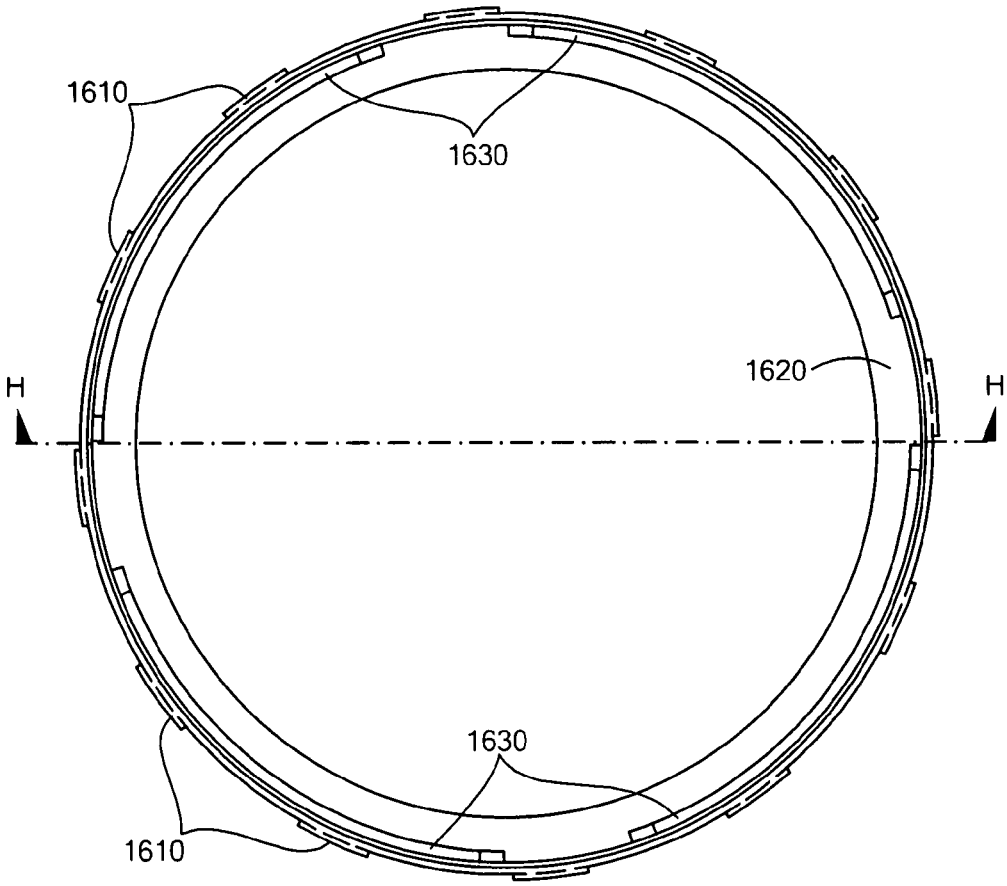
Figure 9C:
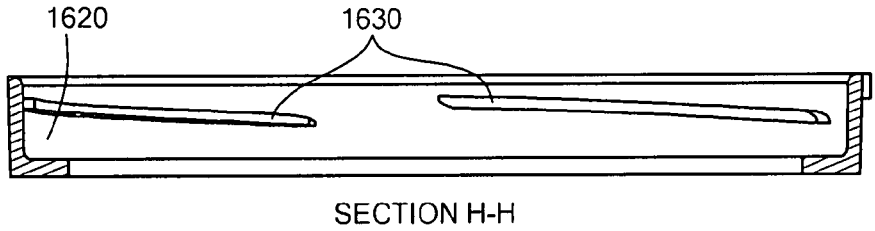

FIGS. 9 A-C show a unitizing ring 120, according to an embodiment of the four piece liquid container system. FIG. 9A shows the ring 120 in a perspective view. The ring is generally annular in shape with the periphery of the annulus shaped to match the recess 1540 in the lip of the outer cup 110. The ring include tabs 1610 extending outward from the top of the ring such that the tabs 1610 mate with slots 1550 in the top of the outer cup to prevent rotation of the ring with respect to the cup. The ring 120 includes a recess 1620 for receiving and supporting a lip at the open end of the liner, as will be described below. The ring recess 1620 is annular in shape with a circular periphery, but, in general, may assume any shape that corresponds to the shape of the lip of the liner. The inside of the unitizing ring includes rib segments 1630 that extend inwardly from the inner wall of the ring. These rib segments 1630 are generally parallel to the plane of the ring 120 and may be pitched slightly downwardly toward the cup end of the ring to act as screw threads for securing a lid to the ring.

FIG. 1 shows, in perspective, as described above, the components that may be included in a four piece liquid container system, according to an embodiment of the invention. These components are further shown in FIGS. 8-10. The unitizing ring 120 is inserted into the recess in the lip at the open end of the outer cup 110. A liner 130 is inserted into the unitizing ring, with a lip at the top of the liner resting on a recess 1620 in the ring (see FIG. 9A). A removable lid 200, as shown in FIG. 10, includes a bottom projection 280 that is inserted into the open end of the liner, after liquid has been poured into the liner. The lid 200 is adapted to contain paint or other liquid within the liner and to prevent air from entering the closed lid/liner combination. Such closure occurs when the spray gun is attached to the assembly for use, or when the container outlet is sealed with a removable cap or plug. The removable cap or plug is used to seal the filled assembly either in preparation for forthcoming use or to store unused paint for future use. The underside of a flange 285 on the periphery of the lid forces the lip of the liner to the recess in the unitizing ring, enabling a liquid-tight seal. In specific embodiments of the invention, the diameter of the lid bottom projection 280 and the inner diameter of the ring recess 1620 are such that the top of the sidewall of the liner is compressed when the lid is attached to the unitizing ring. Compression of the liner sidewall between lid bottom projection 280 and ring recess 1620 in this embodiment aids in forming a liquid tight seal. The lid bottom projection 280 and the inner edge of the ring recess 1620 may both be tapered to aid in assembly of the liner, lid and ring. Tabs or threads 270 at the edge of the lid allow the lid to be screwed into rib segments or threads 1630 on the unitizing ring, securing the lid to ring. A locking mechanism 210 on the lid can secure the lid to the outer cup 110, allowing the liquid container system to be oriented in any direction without detachment of the outer support cup from the system. The securing hinges 210 clip over a flange on the outer cup 110. The tabs are flexibly hinged and biased to snap onto the flange of the outer cup. The lid has an outlet 230 of generally cylindrical shape so that liquid may be transferred from outer cup to the spray gun. The lid outlet, an adapter for connection to a spray gun that mates thereto and means for securing the adapter to the outlet may be constructed as described above in connection with FIGS. 2-5. The locking mechanism shown for connecting the lid to the outer cup is by way of example only and a variety of such mechanisms, as are known in the art, may be used to secure the lid to the cup, in various embodiments of the invention.

The liner shown in FIGS. 6A-6C and described above for embodiments of the invention may be employed in embodiments of the four piece liquid container system. A liner for use in the system, in general, will be:

liquid tight;

open-ended with a lip surrounding the open end, so that the lip may be supported by the recess in the unitizing ring and the lip may be pressed by the compressible flange 285 of the removable lid against the ring recess 1620.

In embodiments of the invention, the four piece liquid container may be coupled with either a gravity feed or a suction feed spray gun, with the outlet of the lid connected to the inlet port of the gun by an adapter, such as the adapter described above. Liquid is withdrawn from the container and fed to the spray nozzle. The gun may be oriented in a wide range of orientations, including an inverted orientation with respect to gravity.

Figure 10A:
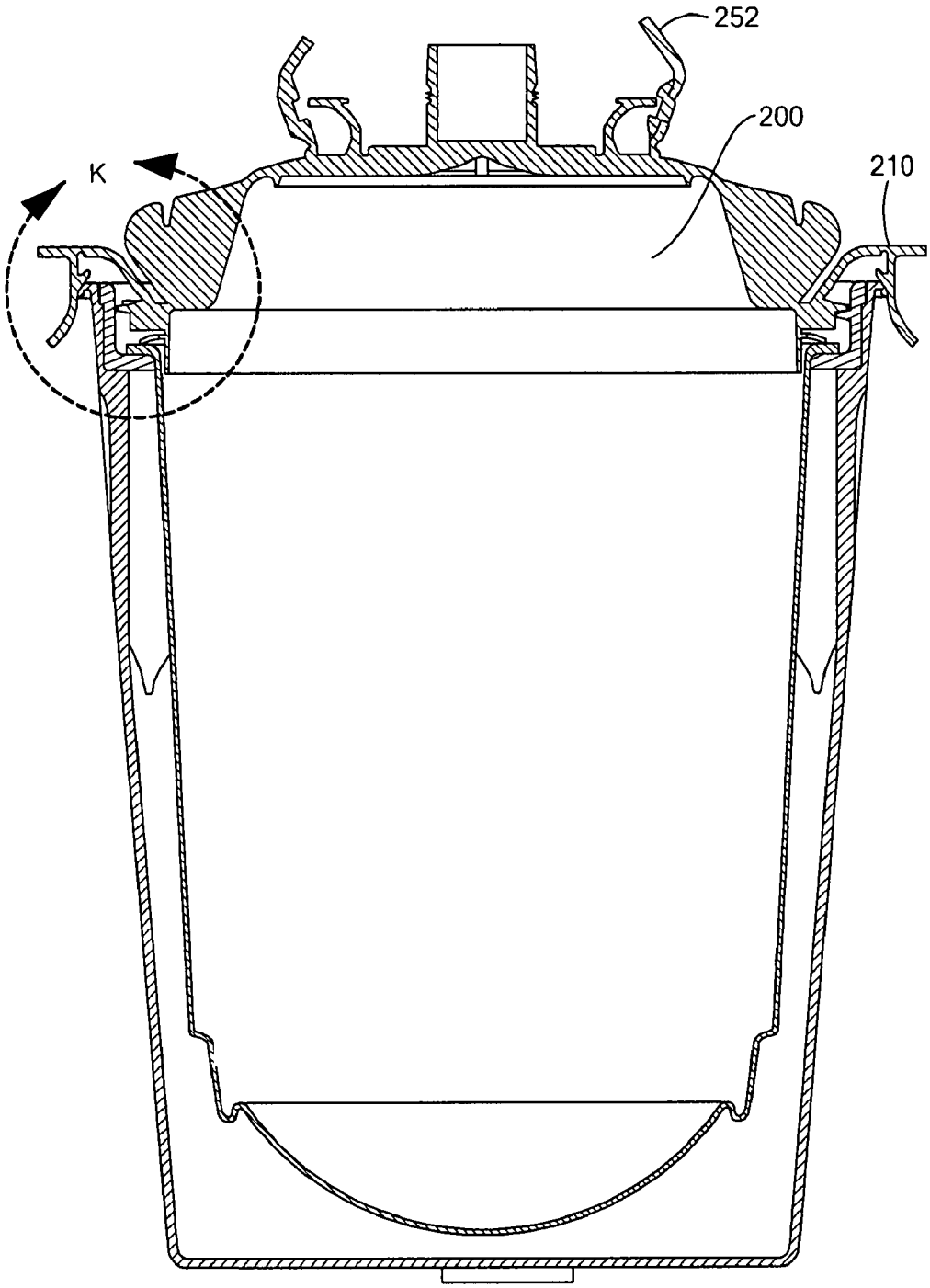
FIGS. 10A-B show a lid with a flexible sealing gasket, according to an embodiment of the invention.
Figure 10B:
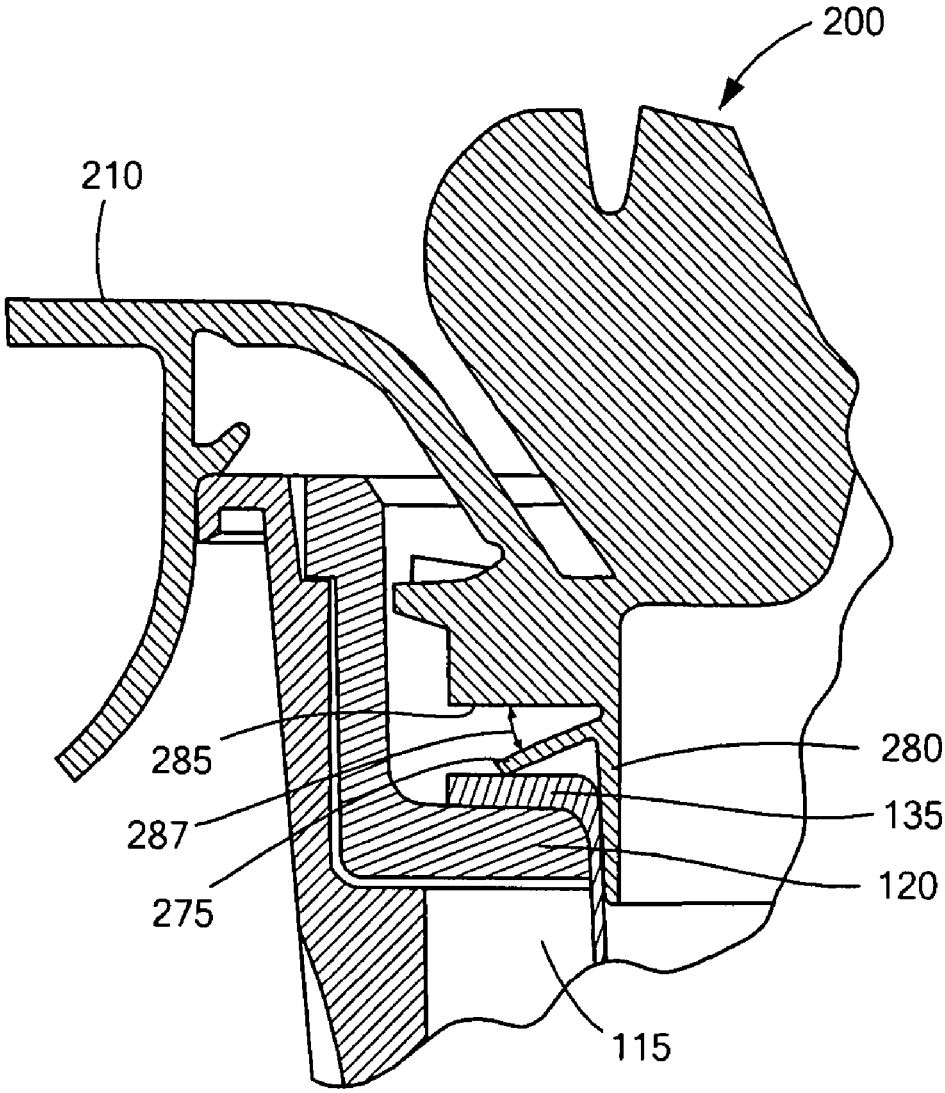

In a further embodiment of the invention, an integrated, compressible flexible sealing gasket is provided at a peripheral edge of a removable container lid in a four piece liquid container system. This sealing gasket forms a liquid tight seal between the lid, liner and ring. The liquid container system may be generally similar, for example, to the system described above in connection with FIGS. 1-5 and FIGS. 7-9. FIG. 10A shows a cutaway side view of a four piece container system, employing a flexible sealing gasket on the lid. The sealing gasket 275 is a downward flaring circumferential projection extending from the underside of the flange on the periphery of the lid 285 or from top of the lid bottom projection 280. FIG. 10B shows the detail of the lid-liner-unitizing ring attachment, labeled "K" in FIG. 10A. The lid 200 screws into the unitizing ring 120 and the downward flaring flexible sealing gasket 275 presses the liner lip 135 against the unitizing ring 120, forming a liquid tight seal. The lid projection 280 may press the liner sidewall against the reservoir sidewall 115, as shown, or the dimensions of the lid projection 280 may provide clearance between the lid projection and the liner sidewall ensuring easy insertion of the lid projection into the liner (and reservoir) top. The compressible flexible sealing gasket may be formed by injection molding, for example, as the lid is manufactured, avoiding the cost of a separate extra gasket and the complexity of an additional part. In a preferred embodiment of the invention, the thickness of the sealing gasket is about 0.020 inches, allowing the lip to flex as the lip presses the liner to the ring. In other preferred embodiments, the angle 287 between the flexible sealing lip and the underside of the lid flange 285 at the periphery of the lid is about 30 degrees.

Figure 11A:
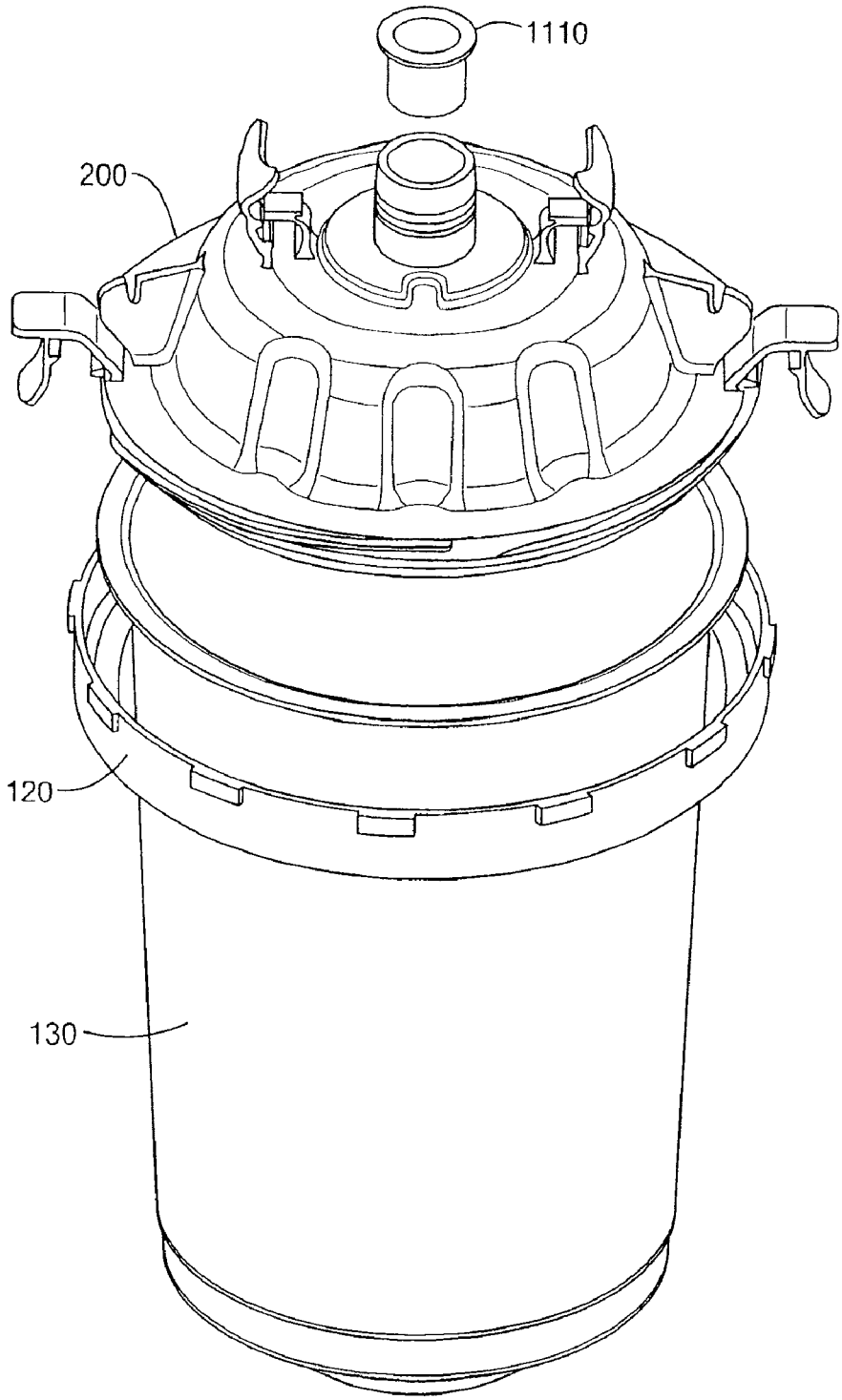
FIGS. 11A-B illustrate a unitized lid-ring-liner combination for storing liquid according to an embodiment of the invention.
Figure 11B:
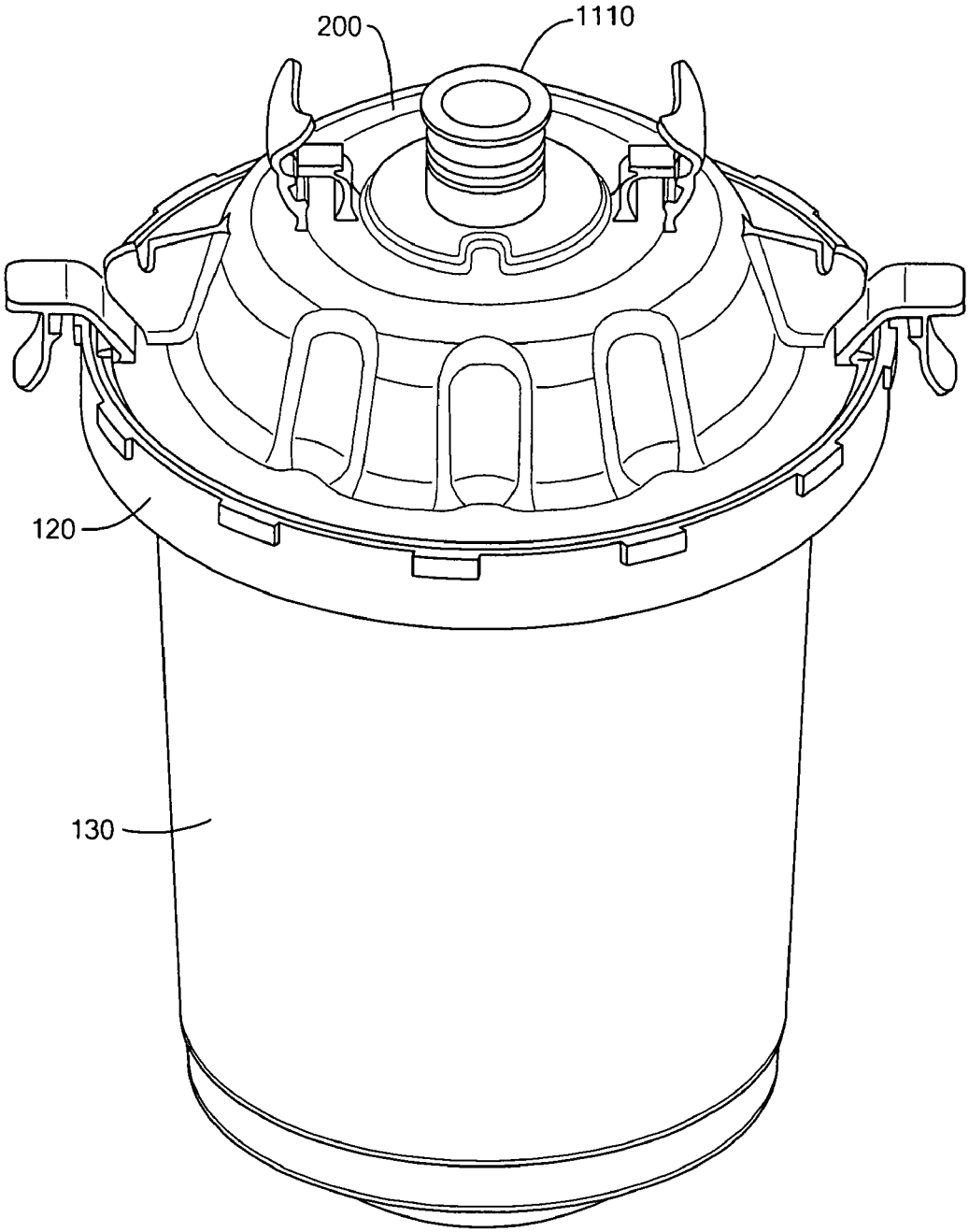

As shown in FIG. 11, the unitized ring-lid-liner combination may be manipulated as a liquid-tight unit, e.g., inserted into and removed from the outer cup. FIG. 11A shows an exploded view of the combination, while FIG. 11B shows the combination assembled. When the combination of FIG. 11B is removed from the cup, the liquid outlet in the lid may be closed with a removable cap or stopper 1110. Advantageously, used paint can be stored and saved without the need for an outer cup. Since a paint shop may have numerous stored paint containers, eliminating the need for an outer cup can provide considerable cost savings. Similarly, paint can be mixed and store temporarily without an outer cup for later use. Further, in disposing of a container with liquid remaining, the unitized system eliminates the danger of the lid separating from the liner as the unit is lifted from the outer cup or as it is tossed into a disposal can. This system eliminates a fire hazard, when the liquid is flammable.

Figure 12:
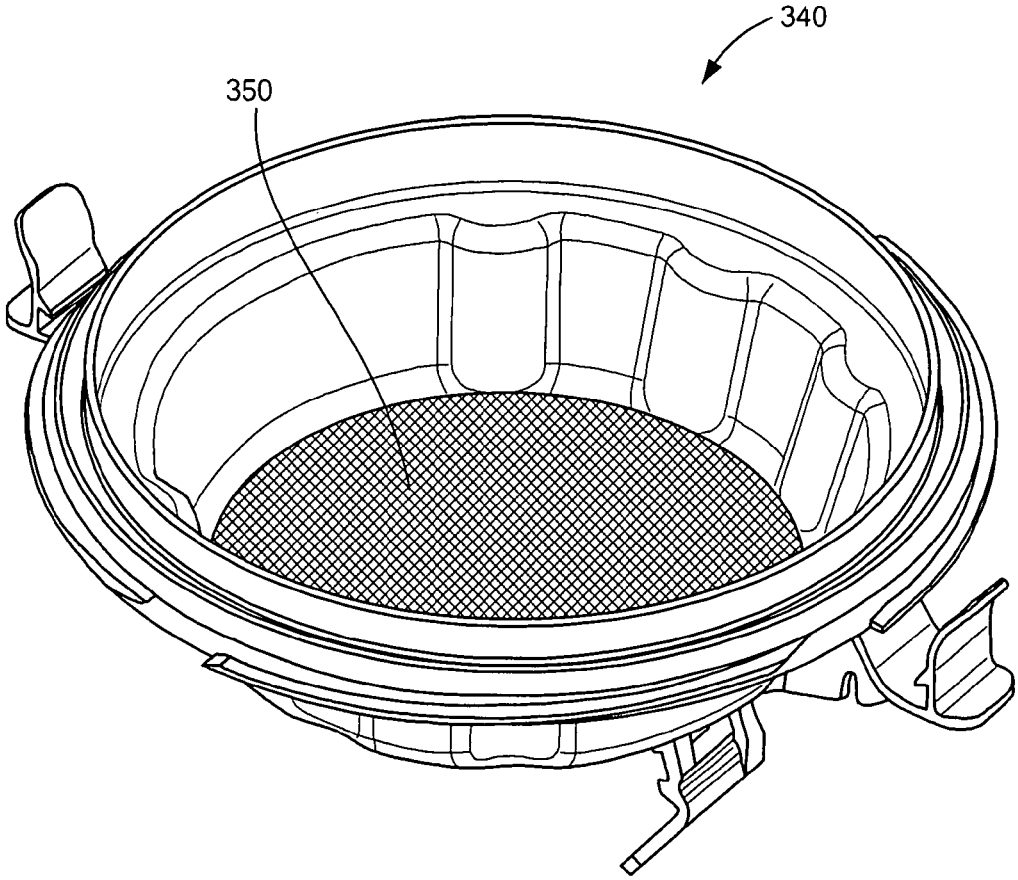
FIG. 12 illustrates a lid with an integral filter according to an embodiment of the invention.

In various embodiments of the invention, a filter may be provided for any of the liquid container systems described above. This filter, which may be removable, filters the liquid withdrawn from the container. In an embodiment of the invention, a filter 350 may be built into the underside of the lid 340 in the container assembly, as shown in FIG. 12. Liquid withdrawn from the container through the lid outlet can thereby be filtered.

It will, of course, be apparent that the present invention is not limited to the aspects of the description set forth above. Various changes and modifications of this invention as described will be apparent to those skilled in the art without departing from the spirit and scope of this invention.

We claim:

1. A liquid container system for a spray gun including:

a cup including an open top, the top including a cup lip, the cup lip including a cup lip recess;

a ring, the ring including a bottom wall and a peripheral flange extending upward from a periphery of the bottom wall, the peripheral flange configured to be inserted into the cup lip recess;

a liner including a liner lip at an open end, the liner insertable through the ring into the cup, the bottom side of the liner lip adapted to rest on the ring bottom wall when the liner is inserted into the cup; and a lid configured to close the open end of the liner, the lid including a flexible gasket that depends from a flange on the periphery of the lid such that the lid, liner and ring form a liquid tight unit.

2. A system according to claim 1, wherein the flexible gasket is about 0.02 inches in thickness.

3. A liquid container system according to claim 1, wherein the ring peripheral flange and the cup are shaped such that rotation of the ring relative to the cup is prevented after insertion of the peripheral flange into the cup lip recess.

4. A system according to claim 1, wherein the angle between the flexible gasket and the underside of a flange on the periphery of the lid is about 30 degrees.

5. A system according to claim 1 wherein the gasket forms a seal between the lid and liner lip.

6. A system according to claim 1, wherein the flange on the periphery of the lid is configured to releasably engage the peripheral flange of the ring.

7. A system according to claim 1, wherein the cup lip recess is formed on an inner periphery of the cup lip, and the ring recess is formed on an inner periphery of the ring peripheral flange.

8. A system according to claim 1, wherein the lid further comprises a locking mechanism configured to releasably secure the liquid tight unit to the cup.

9. A system according to claim 1, wherein the flange on the periphery of the lid includes threads that engage threads formed on the peripheral flange of the ring.

10. A system according to claim 9 wherein when the lid engages the threads formed on the peripheral flange of the ring, the gasket compresses against the liner lip forming a liquid tight seal.

11. A system according claim 1, wherein lid further comprises a locking clip configured to releasably engage with the cup lip.

12. A system according to claim 11 wherein the locking clip is flexible and configured to clip to the cup lip.

13. A liquid container system for use with a spray gun, comprising:

a cup having an open top with a cup lip recess;

a ring having a bottom wall and a peripheral flange extending upward from a periphery of the bottom wall, the peripheral flange receivable within the cup lip recess;

a liner having a liner lip at an open end, the liner lip resting on the ring bottom wall when the liner is inserted into the cup, the liner supported within the cup by the ring; and a lid having a flexible gasket that cooperates with the liner lip to create a liquid tight seal.

14. A system according to claim 13 wherein no part of the liner is in contact with the cup.

15. A system according to claim 13 wherein the ring peripheral flange includes inwardly extending rib segments which cooperate with threads formed on an outer periphery of the lid such that rotation of the lid relative to the ring engages the lid with the ring and causes the gasket to compress against the liner lip creating the liquid tight seal and forming a unitized liquid tight lid-liner-ring assembly.

16. A system according to claim 15 wherein the unitized lid-liner-ring assembly is removable from the cup.

* * * * *